United States Patent [19]

Neary

[11] 4,223,931

[45] Sep. 23, 1980

[54] DOORKNOB ATTACHMENT

[75] Inventor: Ralph E. Neary, San Francisco, Calif.

[73] Assignee: Schlage Lock Company, San Francisco, Calif.

[21] Appl. No.: 51,612

[22] Filed: Jun. 25, 1979

[51] Int. Cl.[3] ..... E05C 21/00

[52] U.S. Cl. ..... 292/347; 292/DIG. 2; 16/121

[58] Field of Search ..... 74/557, 553; 16/121; 292/DIG. 2, 347, 336.3; D-8/321, 308, 301

[56] References Cited

U.S. PATENT DOCUMENTS

| | | | |
|---|---|---|---|
| D. 219,861 | 2/1971 | Coffman | D8/308 |
| 629,999 | 8/1899 | Jacobs | 74/557 |
| 1,067,575 | 7/1913 | Anderson | 74/557 |
| 1,570,251 | 1/1926 | Hoagland | 74/557 X |
| 2,756,088 | 7/1956 | Sutter | 292/347 |
| 2,801,122 | 7/1957 | Sutter | 292/347 |
| 2,808,282 | 10/1957 | Peoples | 292/DIG. 2 |
| 2,942,909 | 5/1960 | Chase | 292/347 |
| 3,575,453 | 4/1971 | Hohl | 292/347 X |
| 3,827,739 | 8/1974 | Overholser | 292/347 |
| 4,018,465 | 4/1977 | Ramler | 74/557 X |

*Primary Examiner*—Andrew V. Kundrat
*Attorney, Agent, or Firm*—Walter C. Vliet

[57] ABSTRACT

The invention provides a simple, inexpensive, efficient means of converting a standard doorknob into a lever operated doorknob which may be easily operated by the handicapped. The invention allows the use of existing hardware trim and can be retro-fitted to existing installations.

6 Claims, 4 Drawing Figures

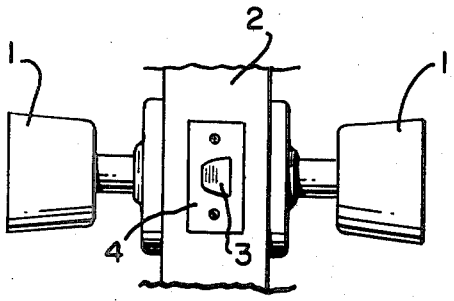
FIG. 1
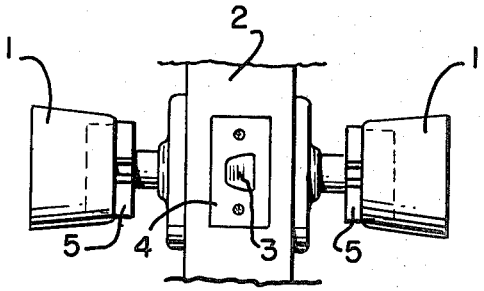
FIG. 2
FIG. 3
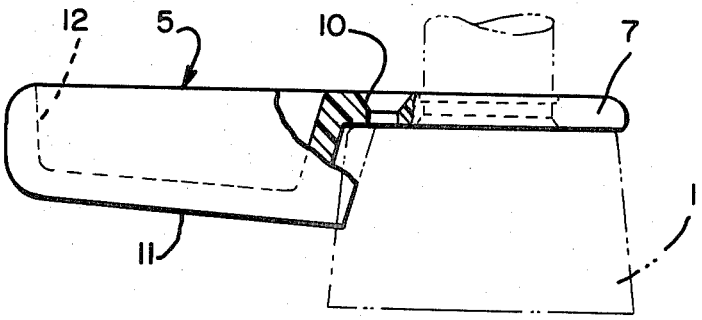
FIG. 4
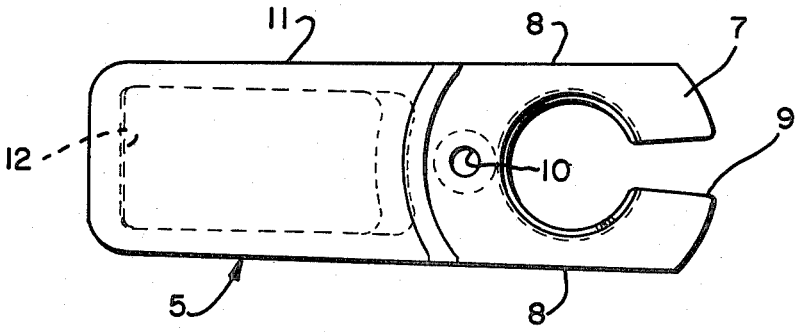

DOORKNOB ATTACHMENT

BACKGROUND OF THE INVENTION

The conventional cylindrical or ball shaped doorknob can be extremely difficult to operate when a good grip of the knob is interfered with for any reason. For example, a wet or oily doorknob may be quite difficult to turn. In addition, when a person does not have a free hand as in the case of carrying packages or the like, it is sometimes difficult to open a door. Further, in the case of handicapped persons, the person may lack the gripping power required to operate the doorknob or lack the wrist mobility necessary to turn the knob. Further, in the case of handicapped persons, particularly amputees, the artificial limb fitted to the handicapped may not be compatible with turning of doorknobs.

For these and other reasons, lever operated doorknobs are finding increased popularity and are specified in many cases for use by handicapped persons in places where handicapped persons are employed or are present.

SUMMARY OF THE INVENTION

The object of the present invention is to provide a simple, reliable, economical, and easy to use and install means for operating a conventional cylindrical or ball shaped doorknob. The object of the invention is to provide a lever operating means for use with a conventional doorknob.

A further object is to provide a lever operating means that is easy to install and does not require special tools for installation. Yet a further object of the invention is to provide a lever operating means which will not detract from the decorative appearance of the doorknob and will allow use of existing hardware trim. A further object of the invention is to provide a lever operating means which has no sharp ends and does not protrude so as to create a hazard on the door. A further object of the invention is to provide a lever operating means which does not appreciably interfere with the normal operating mode of the doorknob. The lever operating means further does not provide an increase in security risk by providing a substantial pry point for illegal entry.

The lever operating means of this invention is easily operated by the handicapped or under other adverse conditions such as emergency exits. These and other objects are obtained in a doorknob operating lever comprising: a mounting portion for mounting the operating lever to a doorknob; a lever secured to the mounting portion; the mounting portion being secured to the back face of a conventional doorknob; and the mounting portion partially surrounding the stem of the doorknob.

BRIEF DESCRIPTION OF THE DRAWINGS

FIG. 1 is an end view of the doorknob showing an existing lock and doorknob;

FIG. 2 is an end view of a doorknob showing the lever operating means of this invention installed in place;

FIG. 3 is a top view of the operating lever as it would normally be installed on a doorknob; and FIG. 4 is a front view of the operating lever.

DESCRIPTION OF PREFERRED EMBODIMENT

Referring to FIG. 1, a conventional doorknob 1 is shown installed on a conventional door 2. The bolt 3 and the latch bolt faceplate 4 are also shown. All being parts of a door lock.

FIG. 2 shows the lever operating device 5 mounted to the rear of a conventional doorknob by means of a mounting screw (not shown). The operating lever in the present invention is comprised of a one piece plastic injection molding. The plastic material may be vinyl or similar material exhibiting some degree of rigidity while retaining a substantial amount of flexibility.

The construction of the operating lever may be seen best in FIG. 3 and FIG. 4. As can be seen, the operating lever comprises two portions. First, a mounting portion 7 which is essentially disc shaped, having two opposed segments removed to form two opposing flats 8 which conform the diameter of the disc to the width of the lever.

In the embodiment herein described, the disc portion is further provided with a slot cut out portion 9 which allows access to the knob release button and further minimizes the availability of the ring portion as a pry point for security purposes. In addition, the ring portion is provided with a counter sunk screw hole 10 which allows a self tapping screw to be utilized to secure the ring portion of the lever to the back of a conventional doorknob.

Extending from one end of the ring mounting portion is a hand lever portion 11. The lever portion 11 provides a convenient means of rotating the knob through its contact with the ring portion of the lever and the mounting of the ring portion of the lever on the doorknob.

In the embodiment shown, the lever portion extends from the ring portion to the left and projects forwardly in the direction away from the door. The lever portion is further provided with a hollowed out recessed portion 12. The hollowed out recessed portion adds flexibility to the handle portion and further allows a means for an artificial limb device such as a hand caliper to grip the lever portion. The recessed portion may be as shown on the back face of the lever, or may be on the front face of the lever, or as a further alternative may be partially on the front face and partially on the back face of the lever portion. The lever portion as shown is generally rectangular in cross section in both the front and top view.

The doorknob operating lever may be manufactured from any convenient solid material. For example, it may be manufactured out of cast aluminum or brass, or preferably in the case of the preferred embodiment as shown, out of semi-rigid material such as vinyl plastic. When manufactured out of a semi-rigid material such as vinyl plastic, it provides additional features such as minimizing the effectiveness of the lever as a pry point for security purposes. It also provides a degree of flexibility in the lever which is desirable to prevent injury and to further effect a more comfortable grip. The lever extending portion is generously radiused as shown. The end of the lever located towards the doorknob is also concave to closely fit the doorknob. This provides minimum clearance between the lever and the doorknob to minimize the possibility of a pinch point.

A further advantage to the use of a material, such as a plastic or semi-rigid plastic such as vinyl, is the fact that in case of fire, the lever will melt away on the fire facing side of the door and will, therefore, minimize the possibility of a water stream being played on the door in a fire situation from hitting the lever and accidentally forcing the door open. This is a further safety consideration in the invention.

The lever actuator of the present invention may be utilized in either the right or the left hand position, or may be mounted in fact in any orientation around the doorknob which would provide for convenience. Being mounted to the rear of the doorknob further provides for easy removal of the operating lever in the event that it is so desired, without marring of the doorknob in its visible portion.

Having described the invention in detail in the preferred embodiment, it should now be obvious to one skilled in the art that numerous modifications of the invention are possible within the scope of the invention. I do not wish to be limited in the scope of my invention except as defined by the following claims.

I claim:

1. An operating lever for a conventional doorknob comprising:

a mounting portion for mounting said operating lever to a doorknob;

a lever secured to said mounting portion;

said mounting portion being substantially secured by screw means to the back face of a conventional doorknob so as not to mar the estetic design of the doorknob;

said mounting portion surrounding the stem of the doorknob for added support;

said lever projecting forwardly from the plane of the door in a direction from the mounting portion of said doorknob lever; and said lever portion is provided with a convex curved surface facing said doorknob and in close proximity to said doorknob to minimize the possibility of a pinch point between said operating lever and said doorknob.

2. The doorknob operating lever of claim 1 wherein: said lever portion is provided with a hollowed out portion to improve grip.

3. The doorknob operating lever of claim 1 wherein: said lever and mounting portion are manufactured from a semi-rigid material.

4. The doorknob operating lever of claim 1 wherein: said doorknob operating lever is manufactured from a plastic material, such as vinyl plastic.

5. The doorknob operating lever of claim 1 wherein: said mounting portion is split to minimize the possibility of said mounting portion being utilized as a pry point.

6. The doorknob operating lever of claim 1 wherein: said lever portion is manufactured from a low melting point material as a fire safety measure.

* * * * *